US008393258B2

(12) United States Patent
Cazalieres et al.

(10) Patent No.: US 8,393,258 B2
(45) Date of Patent: Mar. 12, 2013

(54) RETRACTABLE TURRET

(75) Inventors: Jean-François Cazalieres, Saint Germain du Puy (FR); Jérôme Guillard, Lyons (FR); Laurent Reynard, Bourges (FR)

(73) Assignee: Nexter Systems, Roanne (FR)

( * ) Notice: Subject to any disclaimer, the term of this patent is extended or adjusted under 35 U.S.C. 154(b) by 137 days.

(21) Appl. No.: 12/585,726

(22) Filed: Sep. 23, 2009

(65) Prior Publication Data

US 2010/0071540 A1 Mar. 25, 2010

(30) Foreign Application Priority Data

Sep. 24, 2008 (FR) ..... 08 05234

(51) Int. Cl.
*F41G 3/00* (2006.01)

(52) U.S. Cl. ..... 89/41.01; 89/1.815; 89/1.804; 89/37.21; 89/46

(58) Field of Classification Search ..... 89/1.804, 89/37.21, 46, 41.01, 1.815, 38
See application file for complete search history.

(56) References Cited

U.S. PATENT DOCUMENTS

| | | | | | |
|---|---|---|---|---|---|
| 3,316,809 | A | * | 5/1967 | Riedel | 89/1.815 |
| 3,757,635 | A | * | 9/1973 | Hickerson et al. | 89/36.08 |
| 3,865,009 | A | * | 2/1975 | Kongelbeck | 89/1.815 |
| 4,141,277 | A | * | 2/1979 | Bouillon | 89/38 |
| 4,282,794 | A | * | 8/1981 | Miller et al. | 89/36.15 |
| 4,481,862 | A | * | 11/1984 | Wiethoff et al. | 89/46 |
| 4,574,685 | A | * | 3/1986 | Sanborn et al. | 89/37.14 |
| 4,706,543 | A | * | 11/1987 | Winkler et al. | 89/38 |
| 4,708,052 | A | * | 11/1987 | Argon | 89/41.01 |
| 5,036,748 | A | * | 8/1991 | Pendry | 89/36.13 |
| 5,129,308 | A | * | 7/1992 | Fuereder et al. | 89/36.15 |
| 5,461,961 | A | * | 10/1995 | Baus et al. | 89/1.815 |
| 6,691,600 | B2 | * | 2/2004 | Boudreau et al. | 89/1.815 |
| 7,111,544 | B2 | * | 9/2006 | Kohlstedt et al. | 89/46 |
| 7,669,513 | B2 | * | 3/2010 | Niv et al. | 89/40.03 |
| 8,146,479 | B2 | * | 4/2012 | Cazalieres et al. | 89/36.13 |
| 2004/0134338 | A1 | * | 7/2004 | Dieling et al. | 89/1.804 |
| 2008/0110326 | A1 | * | 5/2008 | Sbrighi | 89/41.01 |

FOREIGN PATENT DOCUMENTS

| | | |
|---|---|---|
| DE | 932 297 | 8/1955 |
| DE | 43 04 761 | 8/1994 |
| FR | 494 292 | 9/1919 |
| FR | 2 149 637 | 3/1973 |
| GB | 118 669 | 9/1918 |
| WO | 2004/097325 | 11/2004 |

* cited by examiner

*Primary Examiner* — Samir Abdosh
(74) *Attorney, Agent, or Firm* — Steptoe & Johnson LLP

(57) ABSTRACT

A retractable turret rotatable on a platform, including an active system orientable in vertically extendable elevation, and in azimuth, a protective cowling for the active system and for closing a caisson, wherein the turret includes, for vertically extendable deployment and rotation of the active system, first and second arms forming a deformable quadrilateral on either side of the active system, a first manual means for controlling deployment of the active system by activating the first arm, and a second manual means for controlling the orientation in vertically extended elevation and in horizontal azimuth of the active system by moving the second arm.

11 Claims, 6 Drawing Sheets

RETRACTABLE TURRET

BACKGROUND OF THE INVENTION

1. Field of the Invention

The scope of the present invention is that of light turrets mounted on a platform.

2. Description of the Related Art

Light turrets are known which equip a platform (vehicle, building, . . . ) and which are intended to support an active system constituted by offensive or defensive weapons and/or offset viewing means such as sights or a camera. Devices are also known of the cannon type that have several barrels mounted in alignment. These are not orientable and have a substantial rigid structure able to withstand the loads. Deployable weapon systems are also known, but these weapon systems may not be reloaded from inside a vehicle.

SUMMARY OF THE INVENTION

The invention thus relates to a light turret mounted so as to be able to retract and incorporating manual deployment means so as to bring it into its position of use.

The invention relates to a retractable light turret mounted able to rotate on a platform, comprising an active system orientable in elevation and in azimuth, a protective cowling for the active system closing a caisson, wherein it incorporates means to deploy the active system constituted by a first and a second arm forming a deformable parallelogram arranged on either side of the active system and elevation and azimuth aiming means for said active system, the deployment being controlled by a first manual means activating the first arm, the orientation in elevation and in azimuth of the active system being controlled by a second manual means activating the second arm.

According to one characteristic of the invention, the first arm is linked in rotation to a shaft integral with a support fixed to the caisson.

According to another characteristic of the invention, the first manual means are constituted by a pinion and worm assembly linked to a control organ to orient the active system in azimuth.

According to another characteristic of the invention, the worm is integral with the shaft and thus with the first arm and the pinion is integral with the control organ.

According to another characteristic of the invention, the control organ can be maneuvered laterally to drive the pinion in rotation which then drives the worm.

According to another characteristic of the invention, the second arm is linked in rotation with an angular member in the form of an L integral in rotation with a support fixed to the caisson, one end of the L being linked to this second arm and the other end to a maneuvering handwheel used to orient said active system in elevation.

According to another characteristic of the invention, the cowling is linked to the active system by means of at least one fastening lug forming a hinge, spring means being provided that enable the cowling to be pivoted so as to disengage a front face of the active system in its deployed position.

According to another characteristic of the invention, the handwheel can be maneuvered in two directions, one in a horizontal plane to position the active system in azimuth or in direction and the other in a vertical plane to position the active system in elevation or in altitude.

According to another characteristic of the invention, the caisson forms a closed enclosure providing sealing between the exterior and the interior of the platform, the caisson incorporating an opening that is closed by a shutter providing access to the active system when the latter is in its retracted position.

According to another characteristic of the invention, the active system may be oriented in elevation at an angle of between −10° and 60°.

A first advantage of the light turret according to the invention lies in the fact that it occupies a reduced volume and because of this makes ammunition reloading possible in all positions and over the complete turning area.

Another advantage of the invention lies in the fact that no electrical energy is necessary to bring the light turret into its elevation and azimuth positions.

Yet another advantage of the invention lies in the fact that orientation in elevation only requires traction and extension movements of moderate amplitude that may be easily performed by an operator even within a small space.

BRIEF DESCRIPTION OF THE DRAWINGS

Other characteristics, particulars and advantages of the invention will become more apparent from the detailed description given hereafter by way of illustration and with reference to the perspective views in which.

DETAILED DESCRIPTION OF PREFERRED EMBODIMENTS

It is known that light turrets are able to support one or several active systems. These systems may be viewing means, weapons or defense means. In the embodiments described hereafter, this active system is represented by a multibarrel unit enabling projectiles to be fired (for example masking or decoy projectiles). Naturally, this example is in no way limitative and this multibarrel unit may be replaced by any other active system. The light turrets are intended to equip a platform such as a vehicle or a fixed structure like a building, where the exterior is differentiated from the interior.

Figure 1:
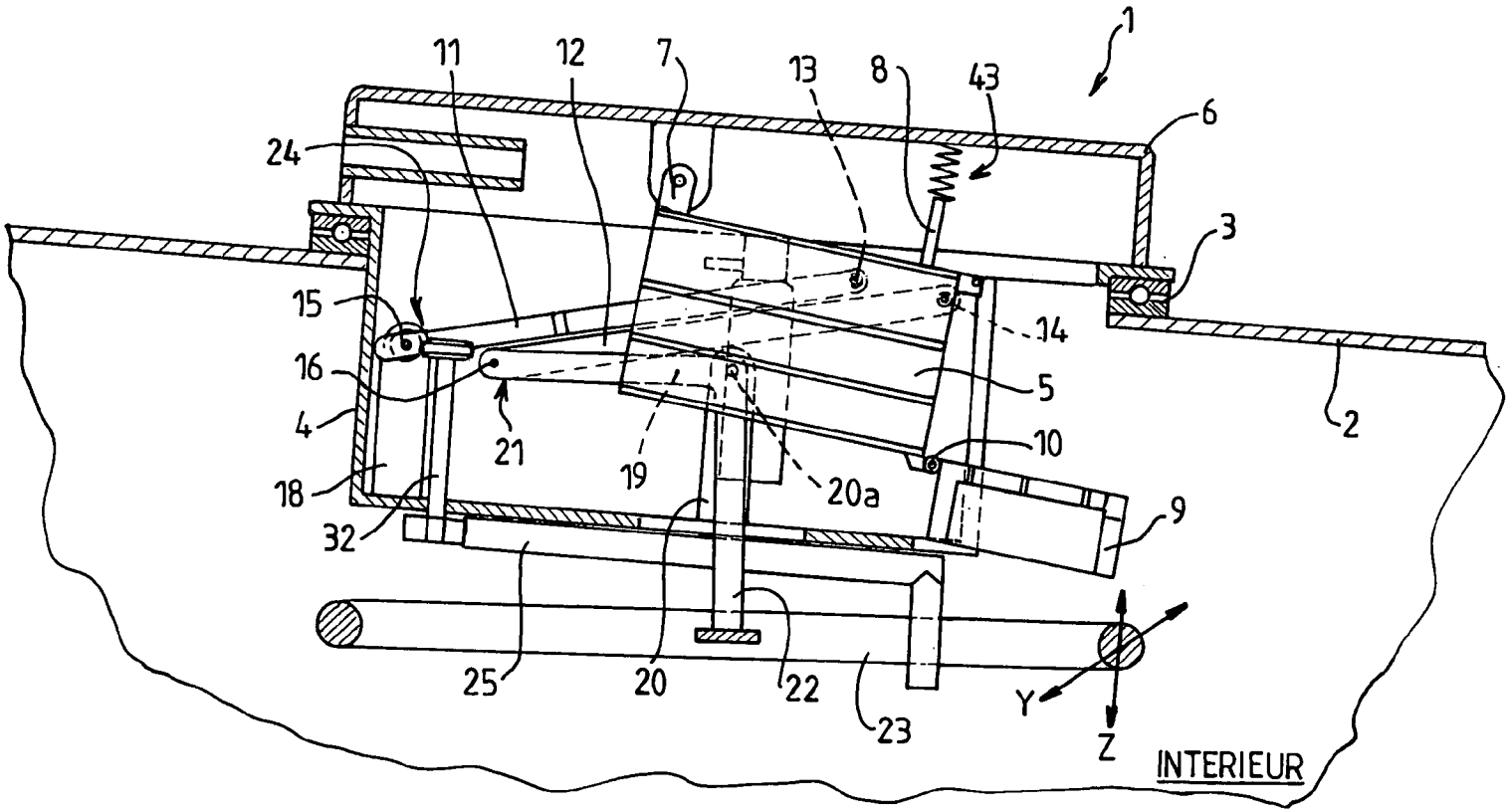
FIG. 1 shows the light turret according to the invention, in its retracted position.

FIG. 1 shows a section of a light turret 1 according to the invention fixed onto a platform 2 by means of a bearing 3 enabling a rotation of 360° of this turret. Naturally, sealing means (not shown), for example a seal ring, are provided between the turret 1 and the platform 2 so as to insulate the interior of the platform 2 from the exterior. The light turret comprises a caisson 4 enclosing an active system 5 to which it is connected by a deformable quadrilateral which is sometimes a parallelogram. The caisson 4 is closed by a protective cowling 6 that is fastened to the active system 5 by a fastening lug 7 that constitutes a hinge. Spring means 43 are provided between the cowling 6 and a rear lug 8 integral with the active system 5. Thus, when the system 5 is deployed, the cowling 6 pivots on its hinge and tips over through the action of the spring 43. Such an arrangement enables the front face of the active system 5 to be disengaged.

In FIG. 1, the system 5 is shown in its retracted position and the spring 43 is stretched.

The active system 5 is here constituted by a unit with launcher tubes 41 enclosing ammunition and closed at the rear by a breech 9. In the Figure, the breech 9 is shown in the open position being linked to the unit by a hinge 10. In the open position, the unit is accessible for loading ammunition via the interior of the platform 2 where the turret crew is located. The mobile breech 9 comprising a percussion system is locked at the rear part of the unit and ensures the firing chain for the ammunition selected. Unlocking means enable this mobile breech to be unlocked.

The deformable quadrilateral, sometimes parallelogram, is constituted by an assembly of arms arranged on either side of the system 5. In the section FIG. 1, only one pair of arms can be seen, a first arm 11 and a second one 12. This quadrilateral constitutes the deployment means for the active system 5 to take it from the vertically retracted or closed position shown in this Figure to a vertically extended deployed position described hereafter. The arms 11 and 12 are linked to the system 5 by hinges, respectively 13 and 14, and to the caisson 4 by hinges, respectively 15 and 16.

Figure 5:
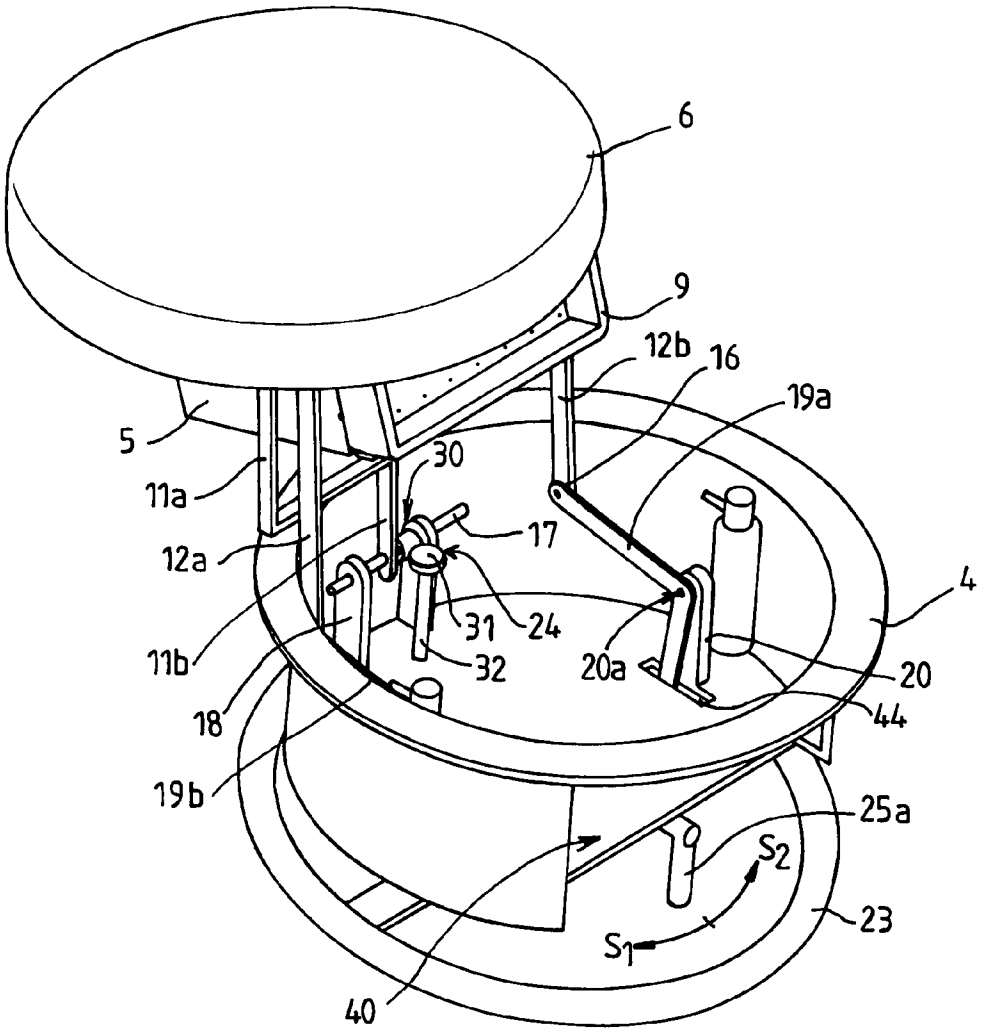
FIG. 5 is a view showing the interior of the light turret.

The first arm 11 is integral with a shaft 17 (FIG. 5) that pivots at hinges 15 with respect to two supports 18 fastened to the caisson 4 (see FIG. 5). The hinge 16 of the second arm 12 is linked to an angular member 19 that is in the form of an L pivoting on a shaft 20*a* integral with a support 20 fastened to the caisson 4. One end 21 of the L is linked to the second arm 12 by a hinge 16 and the other end 22 is integral with a maneuvering handwheel 23 to orient said active system 5 in elevation.

The handwheel 23 can be maneuvered in two directions Y and Z.

Along direction Y, which is substantially horizontal and perpendicular to the plane of FIG. 1, the handwheel 23 is fixed with respect to the caisson 4. It is thus possible to make the caisson 4 pivots manually on the bearing 3 so as to orient the caisson 4 (as well as the system 5) in azimuth (or in direction). The bearing 3 enables pivoting of 360°. Thus, the system 4 may be oriented in azimuth at any time by the crewmember inside the platform and this in any direction.

In direction Z, which is substantially vertical and in the plane of FIG. 1, the handwheel 23 that is integral with the angular member 19 is able to pivot around shaft 20*a* to move the second arm 12 as will be explained hereafter and thereby orient the system 5 in elevation (or in altitude).

Figure 2:
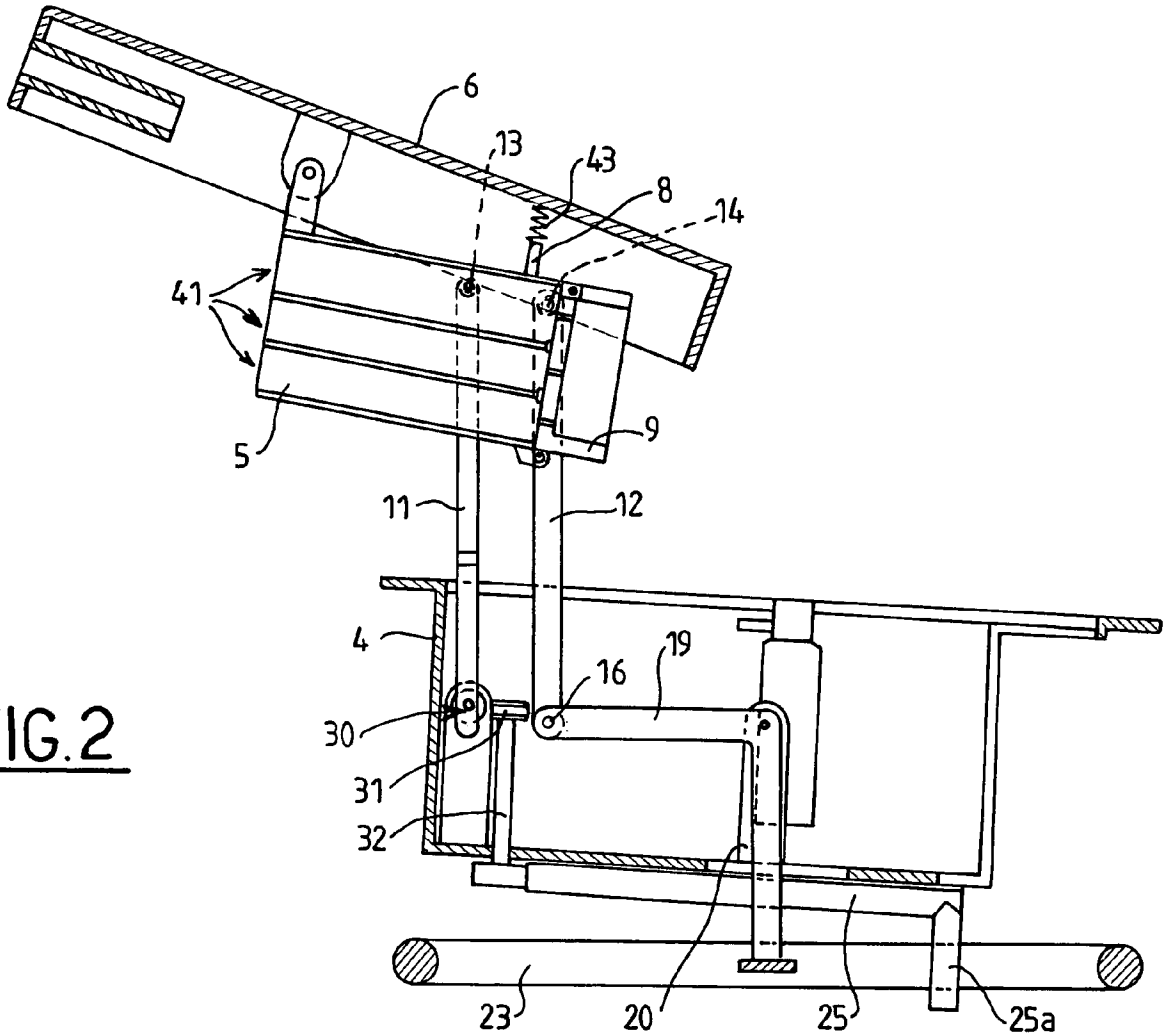
FIG. 2 shows the light turret according to the invention, in its deployed position.

The parallelogram may furthermore be deformed to pass from the retracted position shown in FIG. 1 to the deployed position shown in FIG. 2.

For this, first manual means enable the first arm 11 to be pivoted on its hinge 15. The first manual means 24 are constituted by an assembly comprising a pinion 31 meshing with a worm 30.

The worm 30 is integral with shaft 17 (FIG. 15) which is itself integral with the first arm 11. A rotation of the worm 30 thus drives the pivoting of the arm 11 on hinges 15 with respect to supports 18.

The pinion 31 is integral in rotation with a shaft 32 that is able to pivot with respect to the caisson 4 on bearings (not shown). Shaft 32 is furthermore integral with a control organ 25 equipped with a handle 25*a*. Acting manually on the handle 25*a* enables the control organ 25 to be pivoted in a horizontal plane (arrows S1, S2—FIG. 5) thereby making shaft 32 turn on its bearings as well as pinion 31.

Figure 6:
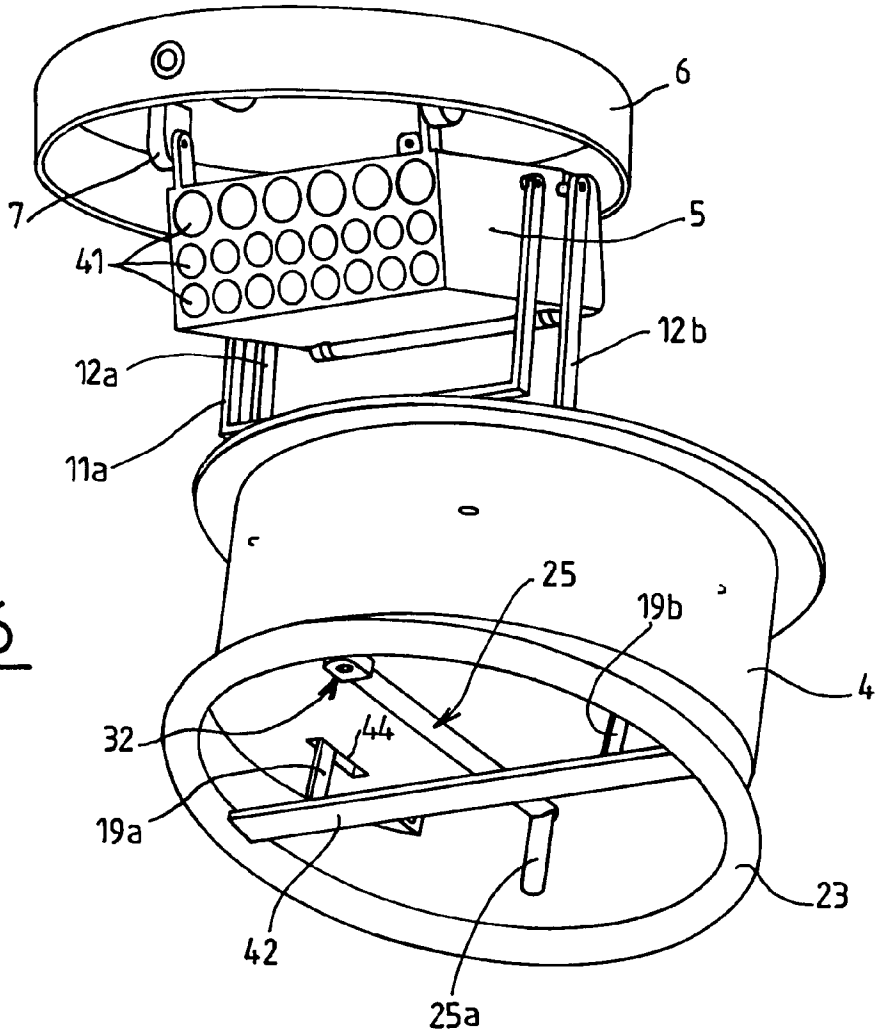
FIG. 6 is a view showing the lower wall of the light turret.

For improved clarity in FIGS. 5 and 6, the control organ 25 has been shown in a middle position. It is clear that this organ is able to pivot with shaft 32 in directions S1 and S2 only until the handle 25*a* butts on a diametral bar 42 integral with the handwheel 23.

So as to use the maximal angular range for the organ 25, the latter is thus found with its handle 25*a* pressing against the bar 42 in its retracted and deployed positions. A first direction S1 will thus be the maneuvering direction to deploy the system 5 and the opposite direction S2 will be that used to retract the system 5. The angular range of the organ 25 will thus be of approximately 90°. The Expert will define the pinion 31 and worm 30 such that a pivoting of the control organ 25 by an angle of around 80 to 90° ensures the full deployment of the system.

The pinion 31 is engaged in the worm 30. By its rotation, it thus makes the latter rotate thereby causing the first arm 11 to rotate and the system 5 to be deployed out of the caisson 4.

FIG. 2 shows the system 5 in the deployed position. This Figure shows the worm 30 fixed to the arm 11 and the pinion 31 integral with the shaft 32, pivoting with respect to the caisson 4 and integral with the control organ 25. By activating the organ 25, the pinion 31 is driven in rotation and consequently the first arm 11 passes from the retracted position shown in FIG. 1 to the deployed position shown in FIG. 2. In this Figure, the cover 6 can be seen to have tipped over with respect to the system 5 via the action of the spring 43. This cover thus occupies its second position and thereby avoids any interference between the ejected ammunition and the cover 6.

Figure 3:
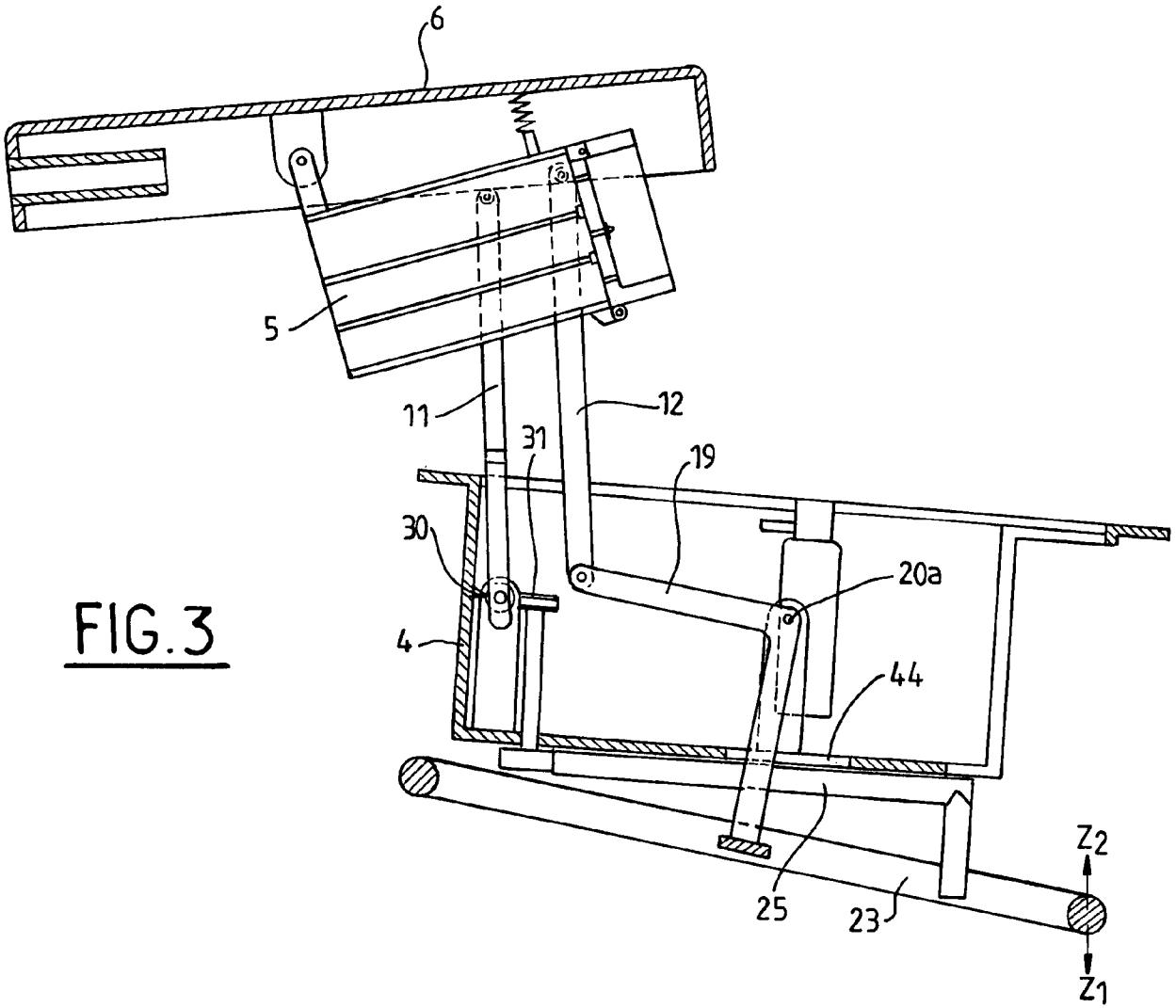
FIG. 3 shows the light turret according to the invention oriented in elevation in an extremely low position.

FIG. 3 shows a deployed position of the system 5 with a low orientation in elevation, position in which the handwheel 23 has been tipped in direction Z1 thanks to the rotation of the angular member 19 around the shaft 20*a* through a slot 44 in the caisson 4. The angular member thus drives the second arm 12 in translation into an extreme high position without any modification to the position of the first arm 11. This rotation enables the system 5 to be positioned at a negative elevation angle of around −5° with respect to the horizontal. Naturally, the system 5 may be oriented in any intermediate position.

Figure 4:
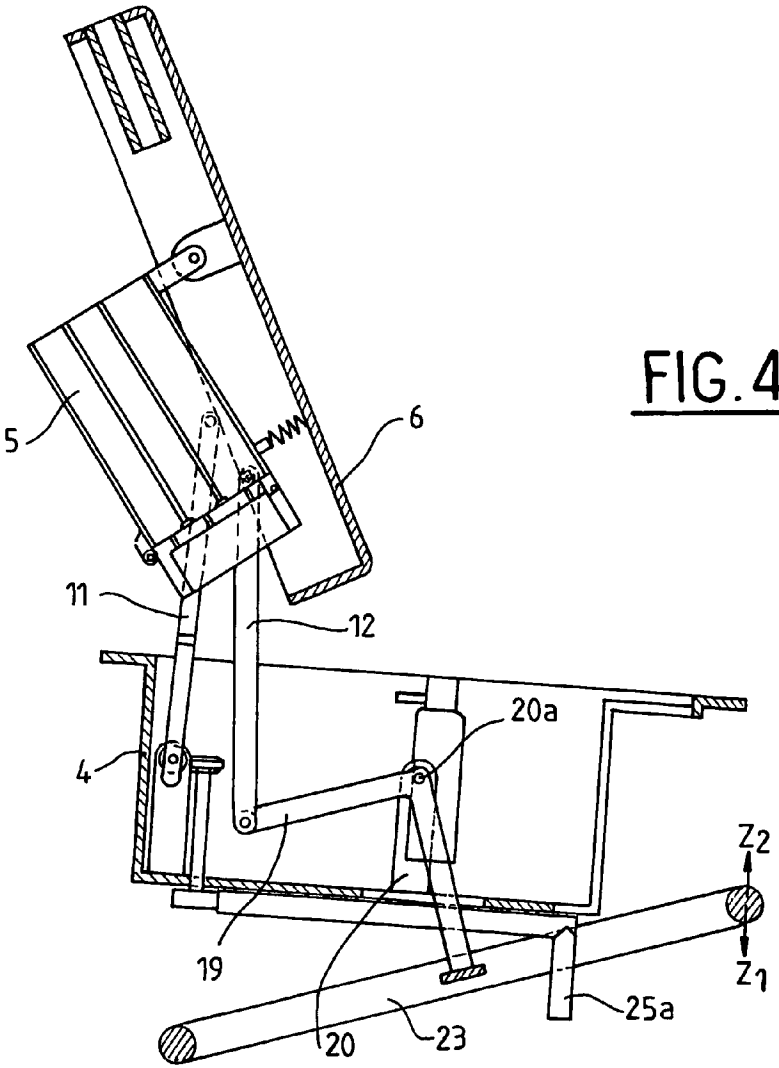
FIG. 4 shows the light turret oriented in elevation in an extremely high position.

FIG. 4 shows a deployed position of the system 5 with a high elevation orientation, such position in which the handwheel 23 has been maneuvered in elevation in direction Z2 thanks to the rotation of the angular member 19 around the shaft 20*a*. The angular member 19 thus makes the second arm 12 translate into an extreme low position without any modification of the position of the first arm 11. This rotation enables the system 5 to be positioned at an elevation angle of around +60°. Once again, the system 5 can be oriented in any intermediate position.

The light turret according to the invention can be seen to take the active system from a retracted position into a deployed position (thanks to the organ 25) and furthermore it enables the elevation of the system to be set (using the handwheel 23) at an angular range of between −5° and +60° with an azimuth of 360°.

The elevation setting may be made from any azimuth position of the system by means of simple manual maneuvering of the handwheel 23. Thus, by adding the angular member 19 to the second arm 12, the orientation in elevation is ensured whilst maintaining the compactness of the assembly in order to house it in the caisson 4.

The manual controls 23 and 25 of the active system 5 mean that no means requiring the use of electrical energy are necessary, thereby making the turret available whatever the circumstances.

FIG. 5 shows a view allowing the interior of the caisson 4 to be seen. In this Figure, the system 5 is in the deployed position and the caisson 4 is provided with an opening 40 by means of which the system 5 may be reloaded with ammunition from the inside of the turret after its breech 9 has been retracted. This opening 40 may be closed by a shutter, not shown, so as to seal the caisson 4 closed. The second arms 12*a* and 12*b* may also be seen that are linked to the angular members 19*a* and 19*b*, only one of which 19*a* may be seen in this Figure, which is linked to the support 20 and passes through the slot 44 to occupy the two extreme positions indicated previously. In this embodiment, the first arms 11 are in the form of a U-shaped frame 11*a* fixed on either side of the cover 6, such frame being linked with the shaft 17 by a single arm 11*b*. This embodiment enables a single system 24 to be implemented formed of a pinion 31 and worm 30 without any modification of its functioning.

FIG. 6 shows the turret from below where the handwheel 23, control organ 25, angular members 19*a* and 19*b* integral with a diametral bar 42 fixed to the handwheel 23 and a slot 44 can be seen. The lugs 7 used to fasten the system 5 to the cowling 6 and the multi launcher tubes 41 may also be seen. The embodiment of the frame 11*a* is also visible. This Figure also shows the end of the shaft 32 onto which the control organ 25 is fastened.

Some skilled in the art will determine simply the embodiment of the arms constituting the parallelogram so as to ensure the necessary resistance to absorb the ammunition firing strains. This ammunition may be identical or different, of the same caliber or of a different caliber.

What is claimed is:

1. A vertically extendable and retractable turret able to rotate on a platform, comprising:

an active system orientable in elevation and in azimuth, a protective cowling for the active system and for closing a caisson, wherein said turret includes means for deployment of said active system comprising a first arm and a second arm forming a deformable quadrilateral on either side of said active system, and elevation and azimuth aiming means for said active system, a first manual means for controlling deployment of the active system by activating said first arm, and a second manual means for controlling the orientation in vertically extended elevation and in azimuth of the active system by activating said second arm, and wherein said caisson forms a closed enclosure between the exterior and the interior of a platform, said caisson having an opening therein that is closed by a shutter providing access to said active system when in its retracted position.

2. A retractable turret according to claim 1, wherein said first arm is linked in rotation to a shaft integral with a support fixed to said caisson.

3. A retractable turret according to claim 2, wherein said first manual means comprise a pinion and worm assembly linked to a control organ to orient said active system in azimuth.

4. A retractable turret according to claim 3, wherein said worm assembly is integral with said shaft and thus with said first arm, and said pinion is integral with said control organ.

5. A retractable turret according to claim 3, wherein said control organ is laterally moveable thereby driving said pinion in rotation thereby driving said worm assembly.

6. A retractable turret according to claim 4, wherein said control organ is laterally moveable thereby driving said pinion in rotation thereby driving said worm assembly.

7. A retractable turret according to claim 1, wherein said second arm is linked in rotation with an angular member in the form of an L integral in rotation with a support fixed to said caisson, one end of said L being linked to said second arm and the other end of said L to a handwheel moveable for orienting said active system in vertically extended elevation.

8. A retractable turret according to claim 1, wherein said cowling is linked to said active system by at least one fastening lug forming a hinge, and spring means for pivoting said cowling to disengage a front face of said active system into a deployed position.

9. A retractable turret according to claim 7, wherein said cowling is linked to said active system by at least one fastening lug forming a hinge, and spring means for pivoting said cowling to disengage a front face of said active system into a deployed position.

10. A retractable turret according to claim 7, wherein said handwheel is movable in two directions, one direction in a horizontal plane to position said active system in azimuth or in direction, and the other direction in a vertical plane to position said active system in vertically extended elevation or in altitude.

11. A retractable turret according to claim 1, wherein said active system is orientable in elevation at an angle of between −10° and 60°.

* * * * *